US005868447A

United States Patent [19]

Clark et al.

[11] Patent Number: 5,868,447

[45] Date of Patent: Feb. 9, 1999

[54] COLLECTION DEVICE FOR SCOOPING REFUSE FOR DISPOSAL

[76] Inventors: Aaron P. Clark; Larry G. Clark, both of 1437 McIntosh Ave., Broomfield, Colo. 80020

[21] Appl. No.: 892,345

[22] Filed: Jul. 14, 1997

[51] Int. Cl.[6] ..... A01K 29/00; E01H 1/12

[52] U.S. Cl. ..... 294/1.4; 15/257.3; 294/55

[58] Field of Search ..... 294/1.1, 1.3–1.5, 294/55, 55.5; 15/257.3, 257.4, 257.6; 141/108, 109, 390, 391; 248/95, 99–101

[56] References Cited

U.S. PATENT DOCUMENTS

| | | | |
|---|---|---|---|
| 501,948 | 7/1893 | Knudson | 294/55.5 |
| 1,621,715 | 3/1927 | Eckley | 294/55.5 |
| 3,688,483 | 9/1972 | Hamilton | 294/1.4 X |
| 3,986,744 | 10/1976 | Krogstad et al. | 294/1.3 |
| 4,149,745 | 4/1979 | Willis | 294/1.4 |
| 4,447,082 | 5/1984 | Lindholm | 294/1.4 |
| 4,646,795 | 3/1987 | Hebron et al. . | |
| 4,723,803 | 2/1988 | Sapp | 294/55 |
| 4,986,587 | 1/1991 | Lozano | 294/1.4 |

*Primary Examiner*—Johnny D. Cherry
*Attorney, Agent, or Firm*—Timothy J. Martin; Michael R. Henson; Mark H. Weygandt

[57] ABSTRACT

A collection device is useful to scoop and bag refuse, such as pet excrement, from a surface. The device includes a handle that supports a working head that has an intake portion, a discharge portion and a guide portion therebetween. The working head has bag holders to secure a bag, such as a plastic grocery bag, with a mouth engaging the discharge portion so that refuse may be introduced into the intake at an upstream end and dumped into the bag at the downstream end. The intake portion has forwardly extending tines. The bag holder is shown as radial posts and/or a ring clamp. The handle may be either a short hand grip or preferably an elongate rod that permits use of the collection device while the user is standing. The working head is preferably cylindrical, but it may be flattened if desired.

19 Claims, 4 Drawing Sheets

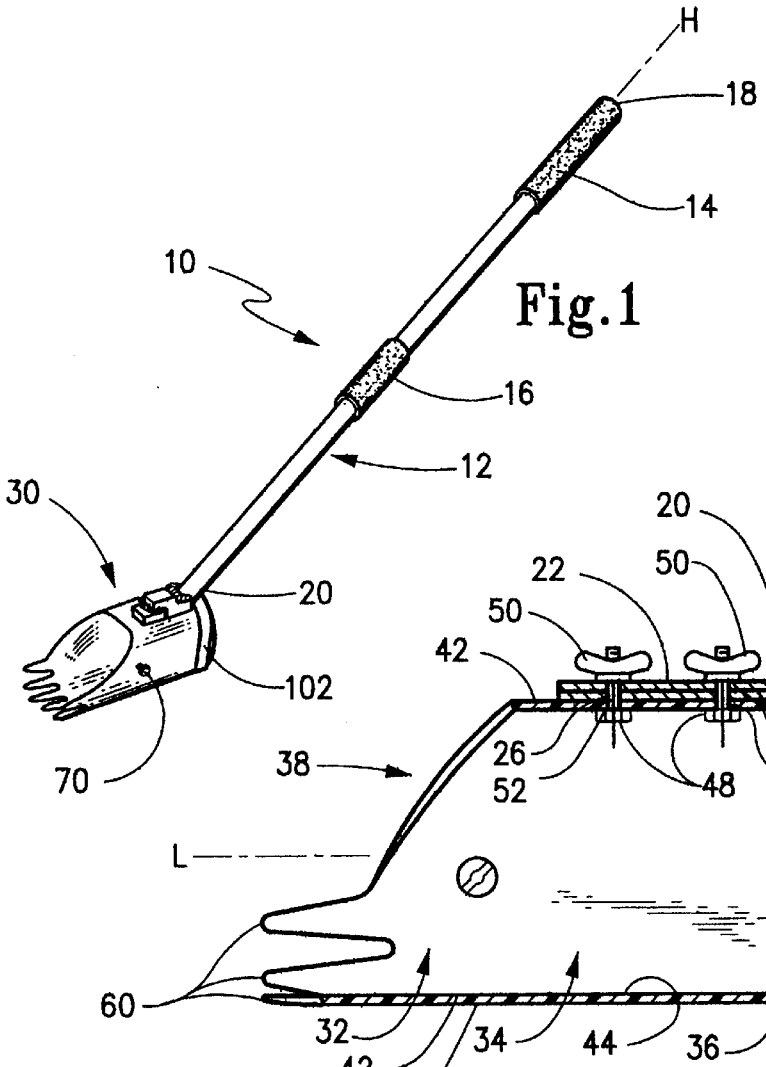
Fig.1
Fig.3
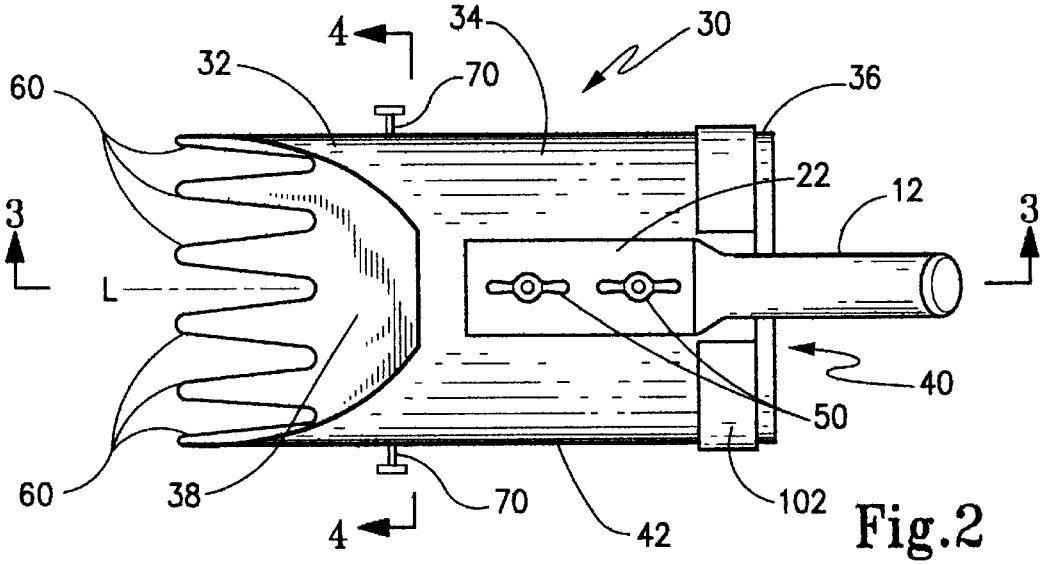
Fig.2

COLLECTION DEVICE FOR SCOOPING REFUSE FOR DISPOSAL

FIELD OF THE INVENTION

The present invention broadly concerns devices which may be used to gather trash, debris or other refuse from a surface. More particularly, the present invention concerns the manual collection and bagging of refuse from a surface on which a person walks such as a lawn area, a sidewalk, driveway and the like. The present invention specifically concerns the pick-up and removal of animal waste.

BACKGROUND OF THE INVENTION

Many human activities generate debris and waste of a wide variety of kind. The management of waste through collection and disposal has increasingly become of concern to many cultures not only from a standpoint of living condition esthetics, but more importantly for hygienic reasons.

Not only is the disposal of waste generated by humans of concern to the hygienic environment, but also the collection and removal of animal refuse, particularly that refuse generated by pets. For example, dogs and cats are common domestic companions of many persons; removal of these animal's fecal material is necessary for a sanitary environment. Such fecal material may be deposited by the pet in both designated toilet areas for the animal and in more public areas when the animal is either allowed to roam free or is walked by its owners.

Indeed, many communities have enacted regulations requiring pet owners to collect the fecal material from their animals when the animals are taken on ambulatory excursions so that the unsanitary fecal material is removed from the public areas. Deposit of such fecal material occurs, naturally, since the animals are relatively uninhibited by their toilet habits in public places.

The collection and disposal of animal refuse is also of concern in private dwellings. Should the animal utilize a private lawn or even a designated "run" as a toilet location, the presence of the fecal material creates a non-hygienic situation, especially should those areas be used as play areas for children. Should the fecal material reside in such areas even for a short duration, such presence attracts undesired insects, such as flies and the like which further exacerbates the unsanitary conditions. Indeed, the fecal material itself can pose a problem should parasites be present therein.

For these reasons, sanitary conditions demand that fecal material be regularly removed from the animal's toilet area. This is true whether the toilet area is in a designated area, such as a dog run or cat litter box, or whether the area is an open area such as a lawn, sidewalk, pathway, etc.

Many people find the collection of animal excrement to be unpleasant and, if undertaken improperly, such collection can be unhealthy. Accordingly, many persons resort either to protective gloves while collecting fecal material or to the use of implements to accomplish this task. In the case of cat litter, many persons employ a slotted scoop which allows the user to remove fecal material from the litter box while the particular litter falls through the slots in the scoop for reuse. Other persons employ such items as dust pans or other implements to clean up after their dogs, for example, when the dogs defecate in public or on private areas.

Considering the magnitude of this problem, it is surprising that there are few commercial products currently available for the efficacious removal of animal refuse.

Accordingly, there has been a significant and long felt need for improved devices that provide a sanitary solution to this problem. There has been a further need for such devices that reduce the unpleasantness of this necessary task.

SUMMARY OF THE INVENTION

It is an object of the present invention to provide a new and useful collection device that may be employed to pick-up refuse of a variety of types.

It is another object of the present invention to provide a collection device which can automatically bag the refuse removed from a support surface.

It is a further object of the present invention to provide a collection device for refuse that is relatively sanitary and which can be easily cleaned for reuse.

Yet another object of the present invention is to provide a collection device for animal excrement wherein a user may remain standing while collecting and bagging such refuse for disposal.

Still a further object of the present invention is to provide a reusable and cleanable collection device for refuse that is less unpleasant to use manually.

To accomplish these objects, the present invention is directed to a collection device adapted for scooping refuse material from a surface and for depositing the refuse material into a bag through the mouth of the bag so that the refuse material may be discarded. Broadly, this invention has a handle which includes a gripping portion sized and adapted to be gripped by the human hand during use. A working head is disposed on this handle and has an upstream intake portion, a downstream discharge portion and a guide portion extending therebetween. The working head further includes a bag holder that is adapted for securing a bag to the working head so that the mouth of the bag is engaged by the discharge portion of the working head whereby refuse material introduced through the intake portion may be advanced along the guide portion and deposited into the bag through the discharge portion.

The working head may take a variety of configurations. Preferably, the working head is a longitudinally extending cylindrical shell that has an intake opening formed obliquely to the longitudinal axis. Further, a plurality of tines project forwardly in an upstream direction as an extension of the sidewall of the cylindrical shell with these tines being spaced from one another. Alternatively, the working head may be configured as a longitudinally extending flat wall having a pair of opposed arcuate walls disposed laterally therealong so that the flat wall and the arcuate walls form the guide portion for the working head. Here again, tines may be formed integrally with the flat wall to extend forwardly in the upstream direction of the working head.

The tines may be forwardly convergent and separated from one another by arcuate portions formed at a desired radius of curvature such as ⅛ inch (0.32 cm). The edge of this arcuate portion is also curved. Moreover, the forward free ends of the tines are preferably rounded and are reduced in thickness at the foremost tip thereof. This reduced thickness is provided by a flat surface formed at a small acute angle with respect to that surface of the tine which is an extension of the inner surface of the surrounding sidewall of one embodiment of the invention or the flat wall of the second embodiment.

The bag holder in either embodiment may be formed by outwardly projecting posts that are adapted to secure a portion of the bag approximate to the mouth thereof. These posts are desirably positioned so as to secure the handle loops of a conventional plastic bag of the type used to bag food items at grocery stores so that the mouth of the bag is relatively tautly engaged by the mouth of the bag. Where the working head is in the form of a cylindrical head, these posts are radially projecting and are circumferentially spaced from one another. Alternatively to, or in conjunction with the posts, the bag holder can include a clamp member which may be a C-shaped ring, that resiliently clamps the bag to the discharge portion of the working head.

While the handle used with the working head may be a simple hand grip for manual manipulation of the working head, the preferred handle is in the form of an elongated rod of sufficient length to allow the user to stand upright while manipulating the working head along a walking surface upon which the refuse to be disposed may be located. This elongated handle may be provided with suitable grips for comfortable use.

These and other objects of the present invention will become more readily appreciated and understood from a consideration of the following detailed description of the exemplary embodiments when taken together with the accompanying drawings, in which:

BRIEF DESCRIPTION OF THE DRAWINGS

FIG. 1 is a perspective view of the collection device according to the first exemplary embodiment of the present invention;

FIG. 2 is a top plan view of the lower handle portion and working head of the collection device shown in FIG. 1;

FIG. 3 is a cross-sectional view taken about lines 3—3 of FIG. 2;

DETAILED DESCRIPTION OF THE EXEMPLARY EMBODIMENTS

The present invention broadly concerns devices or implements that may be used to collect debris or other refuse from a support surface. The invention particularly concerns a collection device especially useful for collecting and bagging animal excrement from lawns, pathways, sidewalks and other such surfaces so that the same may be conveniently and sanitarily disposed. Thus, it is a purpose of the invention to provide a convenient implement that minimizes the unpleasantness normally associated in picking up after one's pet.

Figure 8:
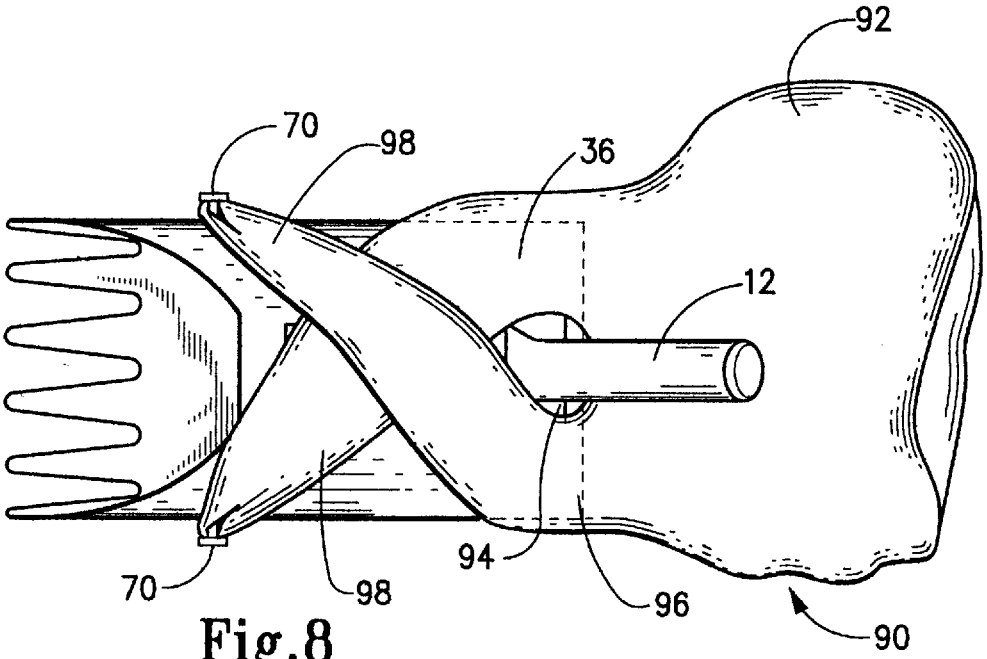
FIG. 8 is a top plan view, similar to FIG. 2, but showing the bag of FIG. 7 attached to the working head of the collection device according to the first exemplary embodiment of the present invention.
Figure 9:
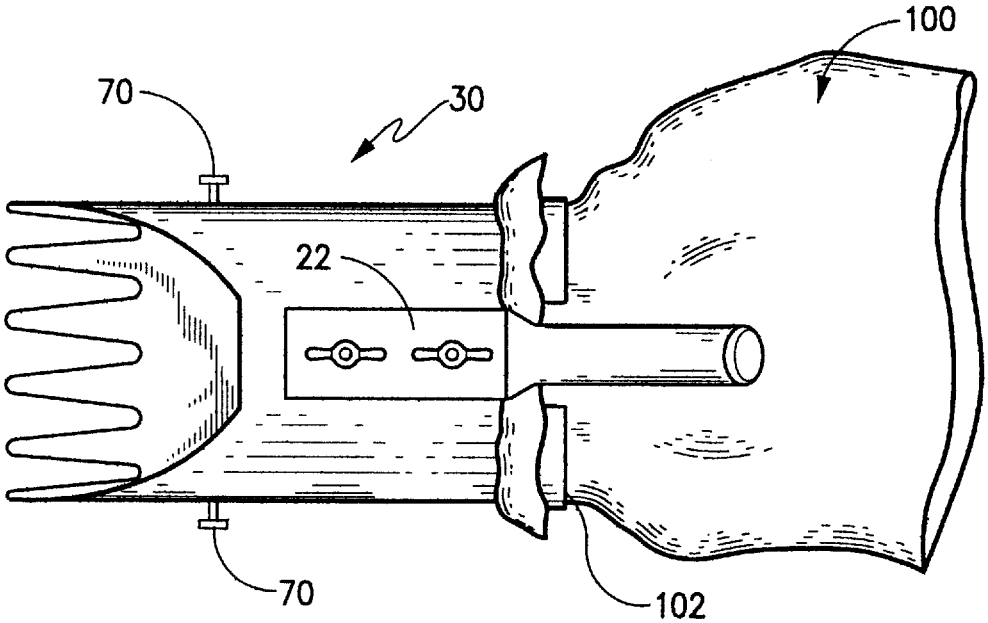
FIG. 9 is a top view in elevation, similar to FIG. 8, but showing use of the present invention with a different type of collection bag.

To understand the present invention, the structure of a first exemplary embodiment is shown in FIGS. 1–6 while the use of this apparatus is shown in FIGS. 8 and 9. Turning to FIGS. 1–6, it may be seen that collection device 10 broadly includes handle portion 12 that is in the form of an elongate hollow rod adapted to be grasped by the human hands. Accordingly, handle 12 includes a pair of grips such as a first grip 14 disposed at one end 18 thereof and a medial grip 16 disposed between first end 18 and second end 20 of handle 12. Grips 14 and 16 may be of any convenient plastic or rubber material commonly used for grips on garden implements, tools and the like.

A working head 30 is secured to handle 12 at a second end 20 thereof. Working head 30 as best shown in FIGS. 2 and 3, includes an upstream intake portion 32, a downstream discharge portion 36 and an intermediate guide portion 34 extending between intake portion 32 an discharge portion 36. Working head 30 is preferably formed as a cylindrical shell having a longitudinally extending axis "L" that is oriented at an angle "a" with respect to handle axis "H". Angle "a" is preferably about 70°. An inlet opening 38 to intake portion 32 is formed obliquely to longitudinal axis "L" so that refuse may be introduced into intake portion 32 through inlet opening 38 and advance towards discharge portion 36 along guide portion 34. Discharge portion 36 thus has an outlet opening 40 that may, for convenience, extend transversely to axis "L".

Working head 30 has a surrounding cylindrical sidewall 42 that may be formed of any convenient material, such as a plastic or metal material, although sidewall 42 is preferably formed of high density polyethylene or an equivalent. Sidewall 42 thus has an interior surface 44 and an exterior surface 46. Handle 12 includes an angled foot 22 which is secured to sidewall 42 by means of bolts 48 and wing nuts 50. Bolts 48 extend through holes 26 in foot 22 that register with corresponding bores 52 through sidewall 42, as best shown in FIG. 3.

Figure 5:
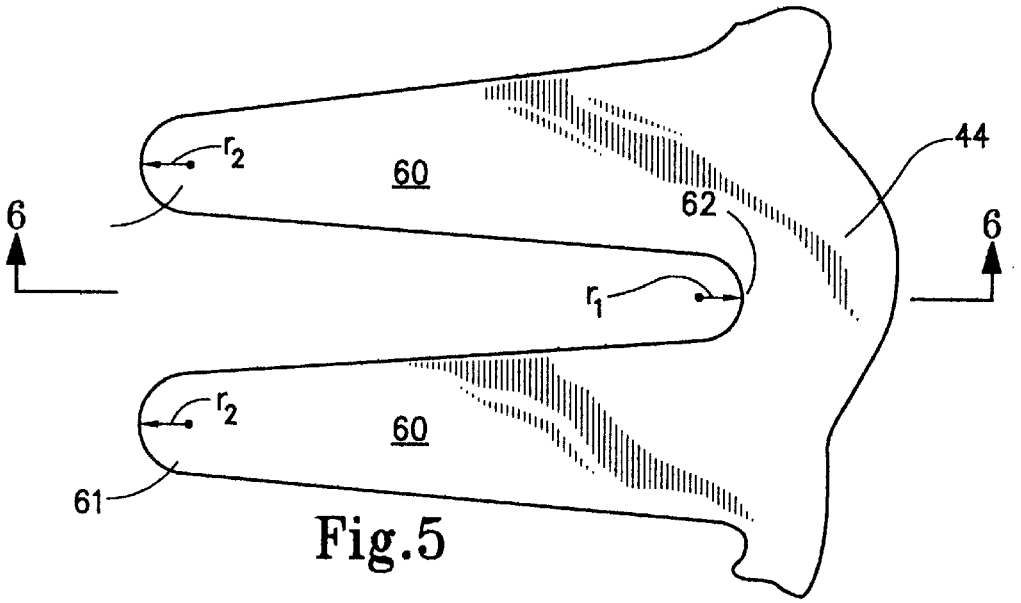
FIG. 5 is an enlarged top plan view showing a pair of tines that forms part of the working head of the collection device shown in FIGS. 1–4.
Figure 6:
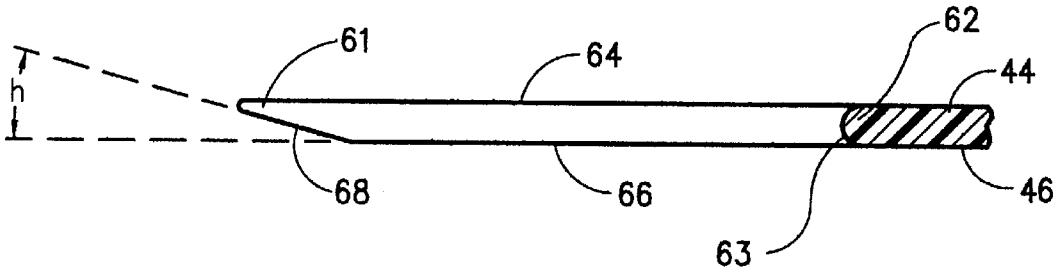
FIG. 6 is a cross-sectional view taken about lines 6—6 of FIG. 5.

Introduction of refuse into intake portion 32 is facilitated by a plurality of longitudinally and forwarding projecting tines 60 which are located at an upstream end of head portion 30 and extend in parallel relation to longitudinal axis "L". In this first exemplary embodiment, six such tines are provided, with each tine being constructed similarly to one another. As is best shown in FIGS. 2, 5 and 6, adjacent tines 60 are joined together by an arcuate margin 62 formed at a radius of curvature "$r_1$" of approximately ⅛ inch (0.32 cm). Each tine 60 converges in a forward direction to terminate in a free end as a rounded tip 61 with tips 61 being formed at a second radius "$r_2$" that is approximately 3/16 inch (0.48 cm). As shown in these figures, each of tines 60 has an inner surface 64 and an outer surface 66 that are respectively formed of extensions of inner surface 44 and outer surface 46 of sidewall 42. The edge 63 also is rounded between surfaces 44 and 46. A flat face 68 is formed at a small acute angle "b" with respect to outer surface 66, as is shown in FIG. 6. Angle "b" is about 20°. Thus, the thickness of each tine 60 is reduced in the forward or upstream direction. This structure helps prevent the snagging of working head 30 on blades of grass when picking up refuse from a lawn or other grassy surface.

Figure 7:
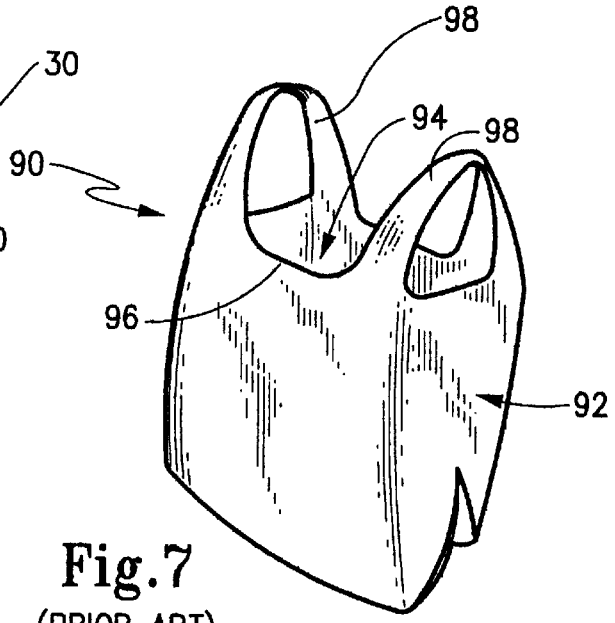
Fig.7 (PRIOR ART)
FIG. 7 is a perspective view of a plastic bag according to the prior art which is used with the collection device shown in FIGS. 1–6.

A conventional bag 90 is shown in FIG. 7, and it should be understood that collection device 10 may use conventional bag 90 to receive refuse from discharge portion 36. As seen in FIG. 7, bag 90 has a main body portion 92 which has an open mouth 94 through which refuse may be inserted. Mouth 94 has a surrounding mouth margin 96 from which a pair of loop-shaped handles 98 project.

Figure 4:
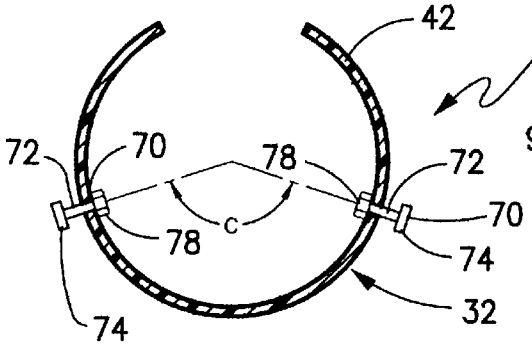
FIG. 4 is a cross-sectional view taken about lines 4—4 of FIG. 2.

In order to releasably secure a bag, such as bag 90, to working head 30, mounting structure defining a bag holder is provided. As is best shown in FIGS. 2 and 4, examples of such bag holders include radial posts 70 which are disposed circumferentially about cylindrical sidewall 42 and are sized and configured to receive handle loops 98 so that discharge portion 36 of working head 30 engages mouth margin 96 of bag 90. Posts 70 include an upright shank 72 and an enlarged head 74. Posts 70 may be secured to sidewall 42 in any convenient manner, such as by screws 78 extending through sidewall 42. It should be understood, however, that the structure of post 70 is by way of example so that other bag fasteners or post constructions may be readily substituted for post 70, if desired. Indeed, it may be preferred to mold posts 70 integrally with sidewall 42 in an injection molding fabrication process.

Figure 10:
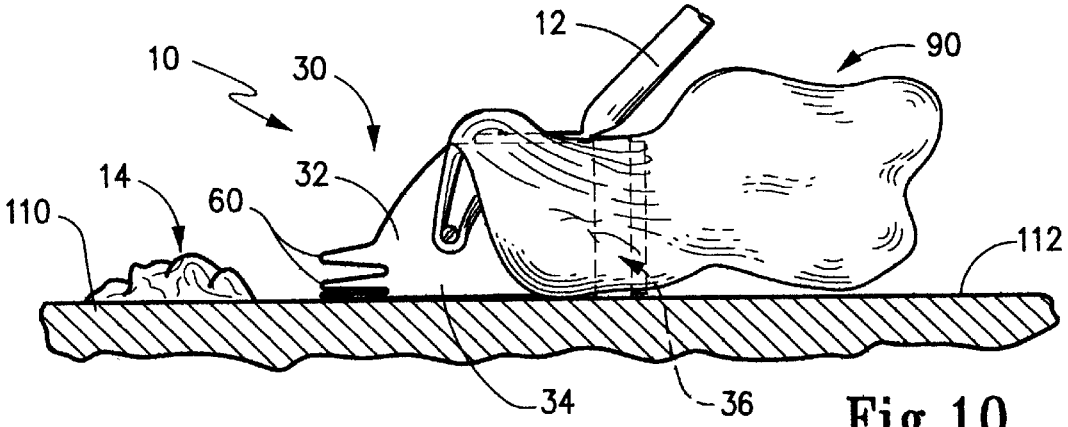
FIG. 10 is a side view in elevation showing the use of the first exemplary embodiment of the present invention for picking up refuse from a support surface.

In any event, bag 90 may be conveniently mounted to working head 30 as is best shown in FIGS. 8 and 10. Here, it may be seen that discharge portion 36 is inserted through mouth 94 and loop handles 98 are crossed over the upper portion of working head 30 to be secured to respective posts 70. This draws mouth margin 96 tautly around discharge portion 36. Preferably, working head 30 is about four and ¼ inches (10.8 cm) or greater in outside diameter and about eight inches (20.4 cm) in length. With this dimension, posts 70 should be placed forwardly of opening 40 about four inches (10.2 cm). Moreover, posts 70 should be angularly spaced an angle "c" of about 150° (FIG. 4) from one another and about 105° from foot 22 to accommodate a standard sized plastic grocery bag.

With reference now, to FIGS. 2, 3 and 9, it may be seen that an alternative bag holder may be employed with a simply open mouthed bag 100. Here, a C-shaped ring clamp 102 is sized to resiliently and releasably grip discharge end 36 which may be inserted through the mouth of bag 100 and clamped thereon by the resiliency of clamp 102. To this end, clamp 102 is made of any springy plastic or metal, such as the preferred polyvinyl chloride, as is shown in FIG. 9.

In any event, whether the bag attachment to collection device 10 is accomplished as shown in FIG. 8 or 9, use of the collection device 10 is demonstrated in FIG. 10. Here, it may be seen that working head 30 along with the attached bag, for example, bag 90, may be advanced along the upper surface 112 of support surface 110 so that a quantity of refuse 114 may be collected by tines 60 and advanced into intake portion 32. Thereafter, the user simply elevates working head 30 so that the refuse is passed along guide portion 34 to be discharged into bag 90 through discharge portion 36. Support surface 110 may naturally be a lawn, driveway, sidewalk, path, etc., and it should now be appreciated that by providing working head 30 with an elongate handle 12, the user may conveniently utilize collection device 10 while walking or standing in an upright position. Moreover, after completion of the collection task, the user may rinse working head 30 and, specifically, surfaces 44 and 46 by rinsing working head 30 under running water, such as water from a garden hose. Bag 90 can simply be detached from working head 30 and it and the contained refuse 114 discarded.

Figure 11:
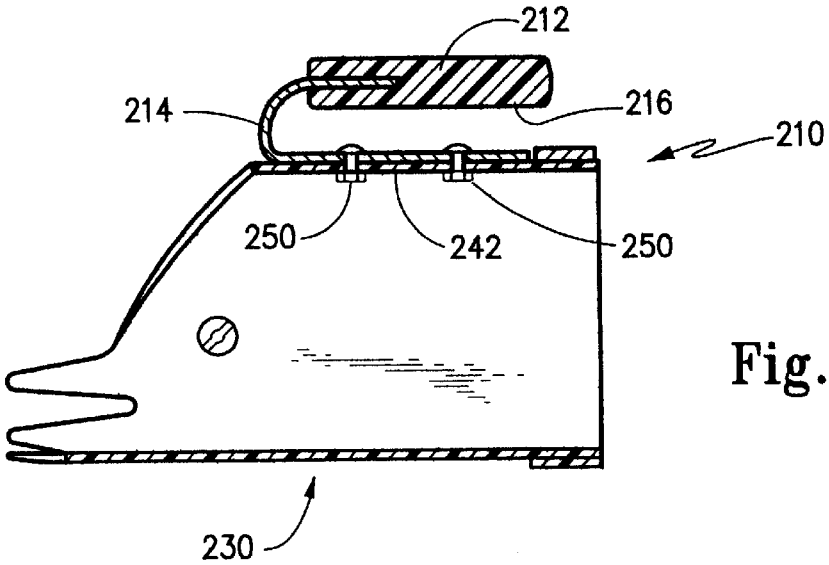
FIG. 11 is a side view in cross-section showing a second exemplary embodiment of the present invention.

A first alternative embodiment of the present invention is shown in FIG. 11. In FIG. 11, collection device 210 has a working head 230 which is substantially identical to working head 30, described above. In FIG. 11, however, it may be seen that collection device 210 has a different handle structure. Here, a handle portion 212 has a hand grip 216 affixed to an arcuate bracket 214 that is attached to sidewall 242 of working head 230 by means of nut and bolt sets 250. Bracket 214 may be a metal strap or other material. Here, it should be appreciated that collection device 210 is operated by a single hand of the user, and may be used in closer quarters, such as, for example, in a cat litter box. It should also be appreciated that the collection device 210 shown in FIG. 11 is more compact and may be desirable where storage space is limited.

Figure 12:
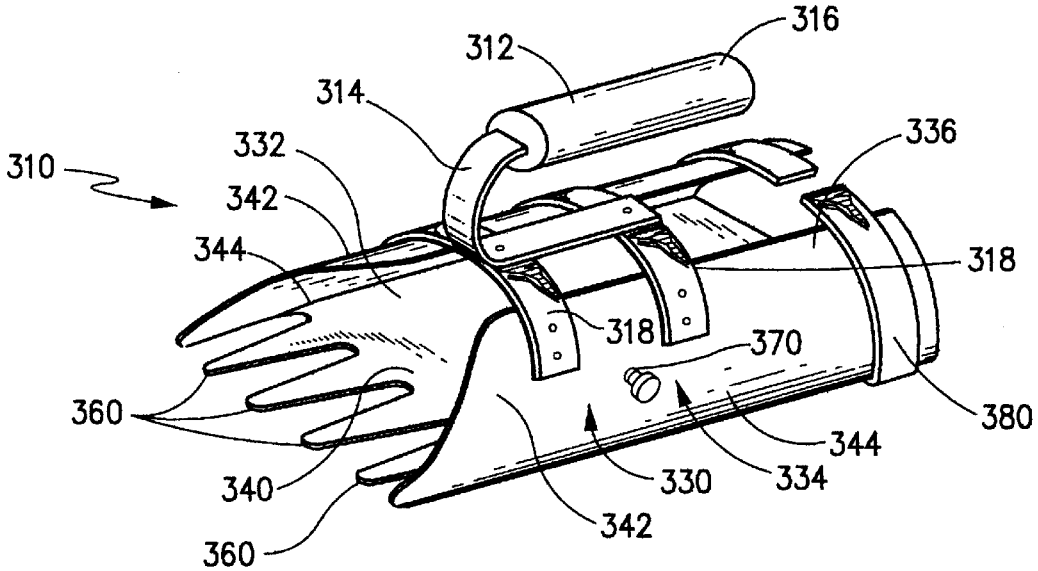
FIG. 12 is a perspective view showing a third exemplary embodiment of the present invention.

A third exemplary embodiment of the present invention is shown in FIG. 12. Here, collection device 310 has a working head 330 secured to a handle portion 312. Handle portion 312 is similar to handle portion 212 and includes a strap 314 interconnecting a hand grip 316 and transverse straps 318 which are riveted to working head 330. Working head 330 includes a flat base wall 340 which extends longitudinally in an upstream direction to terminate in a plurality of tines 360 which are constructed similarly to tines 60, above. A pair of opposed arcuate sidewalls 342 are located along lateral edges 344 of flat wall 340 so that, together, flat wall 340 and arcuate walls 344 define an intake portion 332, a guide portion 334 and a discharge portion 336 for working head 330. Bag fasteners are again provided to secure the mouth margin of a collection bag to working head 330. A pair of posts, such as post 370, may be provided medially of working head 330 for use with a looped handled bag, such as bag 90 shown in FIG. 7. Alternatively, a resilient C-clamp 380 may be used with a non-handled bag, such as shown in FIG. 9.

Accordingly, the present invention has been described with some degree of particularity directed to the exemplary embodiment of the present invention. It should be appreciated, though, that the present invention is defined by the following claims construed in light of the prior art so that modifications or changes may be made to the exemplary embodiment of the present invention without departing from the inventive concepts contained herein.

We claim:

1. A collection device adapted for scooping refuse material from a surface and depositing the refuse material into a bag, said bag having a pair of loop handles proximate to a mouth thereof so that the refuse material may be discarded, comprising:

(a) a handle including a gripping portion sized and adapted to be gripped by a human hand; and (b) a working head disposed on said handle and having an upstream intake portion, a downstream discharge portion and an elongated guide portion extending therebetween, said working head including a bag holder defined by a pair of posts disposed on said guide portion and projecting exteriorly thereof and oriented to engage the loop handles of said bag when the mouth of said baa engages said discharge portion thereby to secure said bag to said working head whereby refuse material may be introduced through said intake portion, advanced along said guide portion and deposited into said bag through said discharge portion.

2. A collection device according to claim 1 wherein said upstream intake portion includes a plurality of tines projecting therefrom in spaced-apart relation to one another.

3. A collection device according to claim 2 wherein adjacent ones of said tines are joined together at a common arcuate base formed at a radius of about ⅛ inch (0.32 cm).

4. A collection device according to claim 2 wherein free ends of said tines are rounded in configuration.

5. A collection device according to claim 2 wherein the free ends of said tines are tapered in thickness such that the thickness becomes reduced in the upstream direction.

6. A collection device according to claim 2 wherein said posts, said guide portion and said tines are formed as an integral, one-piece molded construction.

7. A collection device according to claim 1 wherein said bag holder includes a clamp member disposed on said discharge portion.

8. A collection device according to claim 1 wherein said handle is formed as an elongate member of sufficient length whereby a person can stand erect on a support surface while advancing said working head therealong.

9. A collection device according to claim 1 wherein said working head is configured as a longitudinally extending cylindrical shell, said guide portion defined by a sidewall area of said shell.

10. A collection device according to claim 9 wherein said intake portion has an oblique opening at the upstream end of said shell.

11. A collection device according to claim 1 wherein said working head is configured as a longitudinally extending flat wall and a pair of opposed arcuate walls disposed laterally of said flat wall.

12. A collection device adapted for scooping refuse material from a surface and depositing the refuse material into a bag through a mouth thereof so that the refuse material may be discarded, comprising:

(a) a handle including a gripping portion sized and adapted to be gripped by a human hand; and (b) a longitudinally extending working head disposed on said handle and having an upstream intake portion, a downstream discharge portion and a guide portion extending therebetween, said upstream intake portion including a plurality of tines projecting longitudinally and forwardly therefrom in an upstream direction to terminate in free ends, said tines disposed in spaced-apart relation from one another, said guide portion formed as a generally cylindrical surrounding sidewall with said tines being formed as longitudinal, integral extensions of said sidewall.

13. A collection device according to claim 12 wherein adjacent ones of said tines are joined together at a common arcuate base formed at a radius of about ⅛ inch (0.32 cm).

14. A collection device according to claim 13 wherein said base has a base edge that is rounded in thickness.

15. A collection device according to claim 12 wherein said free ends of said tines are rounded in configuration.

16. A collection device according to claim 12 wherein said free ends of said tines are tapered in thickness such that the thickness becomes reduced in the upstream direction.

17. A collection device adapted for scooping refuse material from a surface and depositing the refuse material into a bag through a mouth thereof so that the refuse material may be discarded, comprising:

(a) a handle including a gripping portion sized and adapted to be gripped by a human hand;

(b) a working head disposed on said handle and having an upstream intake portion, a downstream discharge portion and a guide portion extending therebetween, said working head configured as a longitudinally extending cylindrical shell having a surrounding sidewall with inner and outer sidewall surfaces, said upstream intake portion including a plurality of tines projecting longitudinally therefrom in spaced-apart relation from one another as extensions of said sidewall; and (c) a bag holder for securing a bag thereto such that said bag is supported by said working head with said mouth engaged by said discharge portion whereby refuse material may be introduced through said intake portion, advanced along said guide portion and deposited into said bag through said discharge portion, said bag holder includes a pair of radially extending, outwardly projecting posts disposed on said guide portion.

18. A collection device according to claim 17 wherein said tines terminate in free ends each having a flat end surface formed at an acute angle with respect to an inner tine surface that is an extension of the inner wall surface so that said free ends are tapered in thickness such that the thickness becomes reduced in the upstream direction.

19. A collection device adapted for scooping refuse material from a surface and depositing the refuse material into a bag through a mouth thereof so that the refuse material may be discarded, comprising:

(a) a handle including a gripping portion sized and adapted to be gripped by a human hand; and (b) a working head disposed on said handle and having an upstream intake portion including a plurality of tines projecting therefrom in spaced-apart relation to one another with adjacent ones of said tines joined together at a common arcuate base formed at a radius of about ⅛ inch (0.32 cm), a downstream discharge portion and a guide portion extending therebetween, said working head including a bag holder for securing a bag thereto such that said bag is supported by said working head with said mouth engaged by said discharge portion whereby refuse material may be introduced through said intake portion, advanced along said guide portion and deposited into said bag through said discharge portion.

* * * * *